US006024302A

United States Patent [19]

Sumida et al.

[11] Patent Number: 6,024,302

[45] Date of Patent: Feb. 15, 2000

[54] CYLINDER INJECTION TYPE FUEL INJECTION VALVE

[75] Inventors: Mamoru Sumida, Tokyo; Tsuyoshi Munezane; Kensuke Imada, both of Kobe; Hirohisa Ohta, Tokyo, all of Japan

[73] Assignee: Mitsubishi Denki Kabushiki Kaisha, Tokyo, Japan

[21] Appl. No.: 08/870,651

[22] Filed: Jun. 6, 1997

[30] Foreign Application Priority Data

Jul. 31, 1996 [JP] Japan ..... 8-201680

[51] Int. Cl.[7] ..... F02M 51/06

[52] U.S. Cl. ..... 239/585.5; 239/585.1; 29/890.129; 29/890.131; 251/129.15; 251/129.21

[58] Field of Search ..... 239/585.1, 585.4, 239/585.5; 219/270; 29/890.129, 890.131; 251/129.15, 129.21

[56] References Cited

U.S. PATENT DOCUMENTS

| | | | |
|---|---|---|---|
| Re. 35,098 | 11/1995 | Saperstein | 29/890.043 |
| 5,158,236 | 10/1992 | Sugiyama et al. | 239/585.1 |
| 5,178,362 | 1/1993 | Vogt et al. | 29/890.129 X |
| 5,330,153 | 7/1994 | Reiter | 251/129.21 |
| 5,494,223 | 2/1996 | Hall et al. | 239/585.5 |

FOREIGN PATENT DOCUMENTS

| | | |
|---|---|---|
| 38 19 344 A1 | 12/1988 | Germany . |
| 44 26 006 A1 | 1/1996 | Germany . |
| 7-103100 | 4/1995 | Japan . |

*Primary Examiner*—Lesley D. Morris
*Assistant Examiner*—Steven J. Ganey
*Attorney, Agent, or Firm*—Sughrue, Mion, Zinn, Macpeak & Seas, PLLC

[57] ABSTRACT

A cylinder injection type fuel injection valve comprising a valve body of a cylindrical type, a valve seat having an injection nozzle for injecting fuel at the center thereof, a valve capable of abutting on and separating from the valve seat to open and close the injection nozzle, a hollow housing connected to the valve body at one end, a solenoid located in the inside of the housing for operating the valve to be opened and closed, and a core which is connected to the housing at one end to form a magnetic circuit in association with the housing, wherein the connecting portion between the housing and the core is encirclingly welded, whereby connecting strength of the connecting portion between the core and the housing is improved, a change in properties under high combustion pressure can be prevented, and capability of withstanding pressure is improved.

7 Claims, 3 Drawing Sheets

CYLINDER INJECTION TYPE FUEL INJECTION VALVE

BACKGROUND OF THE INVENTION

1. Field of the Invention

The present invention relates to a cylinder injection type fuel injection valve which is attached to a cylinder head for directly injecting fuel into a combustion chamber of a combustion engine.

2. Discussion of Background

FIG. 3 is a side cross-sectional view showing a conventional fuel injection valve, wherein the fuel injection valve generally has a structure of combining a fuel injection valve body having a needle valve and a solenoid for operating the needle valve. In the Figure, a reference numeral 21 designates a core; a reference numeral 22 designates a housing; a reference numeral 23 designates an O-ring for sealing fuel; a reference numeral 24 designates a coil assembly; and a reference numeral 25 designates an air gap. The core 21 and the housing 22 are caulked at a connecting portion therebetween in order to obtain a withstand pressure strength. Further, in the Figure, a reference A designates a caulked portion; a reference numeral 26 designates a valve device; and a reference numeral 27 designates a needle valve of the valve device.

The conventional fuel injection valve is constructed as described above. Therefore, there was a problem that the caulked portion between the core and the housing would loosen under a high combustion pressure; an air gap was changed by an upward movement of the core; and an injection amount was changed by a change of valve suction force, when the conventional structure of fuel injector was used for injecting fuel into cylinder.

Further, there was a return of a caulked portion in a housing when a method of caulking was solely used. Therefore, there was a possibility that an air gap was changed by looseness of the caulked portion.

Further, it is necessary to increase a caulking load in order to increase a strength of caulking. However, there was a problem such that the housing was buckled when the caulking load was increased.

SUMMARY OF THE INVENTION

It is an object of the present invention to solve the above problems, namely, to improve connecting strength at a connecting portion of a core to a housing whereby a change in properties under high combustion pressure is prevented and a withstanding pressure characteristic is improved.

According to a first aspect of the present invention, there is provided a cylinder injection type fuel injection valve comprising a valve body of a cylindrical type, a valve seat having an injection nozzle for injecting fuel at the center thereof, a valve capable of abutting on and separating from the valve seat to open and close the injection nozzle, a hollow housing connected to the valve body at one end, a solenoid located in the inside of the housing for operating the valve to be opened and closed, and a core which is connected to the housing at one end to form a magnetic circuit in association with the housing, wherein a connecting portion between the housing and the core is encirclingly welded.

According to a second aspect of the present invention, there is provided a cylinder injection type fuel injection valve comprising a valve body of a cylindrical type, a valve seat having an injection nozzle for injecting fuel at the center thereof, a valve capable of abutting on and separating from the valve seat to open and close the injection nozzle, a hollow housing connected to the valve body at one end, a solenoid located in the inside of the housing for operating the valve to be opened and closed, and a core which is connected to the housing at one end to form a magnetic circuit in association with the housing, wherein a connecting portion between the housing and the core is welded by a spot welding at a plurality of points.

According to a third aspect of the present invention, there is provided a cylinder injection type fuel injection valve according to the first aspect of the present invention, wherein the connecting portion between the housing and the core is caulked before the welding.

According to a fourth aspect of the present invention, there is provided a cylinder injection type fuel injection valve according to the third aspect of the present invention, wherein the connecting portion between the housing and the core is caulked before the welding.

According to a fifth aspect of the present invention, there is provided a cylinder injection type fuel injection valve according to any one of the first aspect through the fourth aspect of the present invention, wherein the housing and the core are engaged by a transition fit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

An explanation will be given of preferred embodiments of the present invention in reference to FIGS. 1 and 2 as follows.

EMBODIMENT 1

Figure 1:
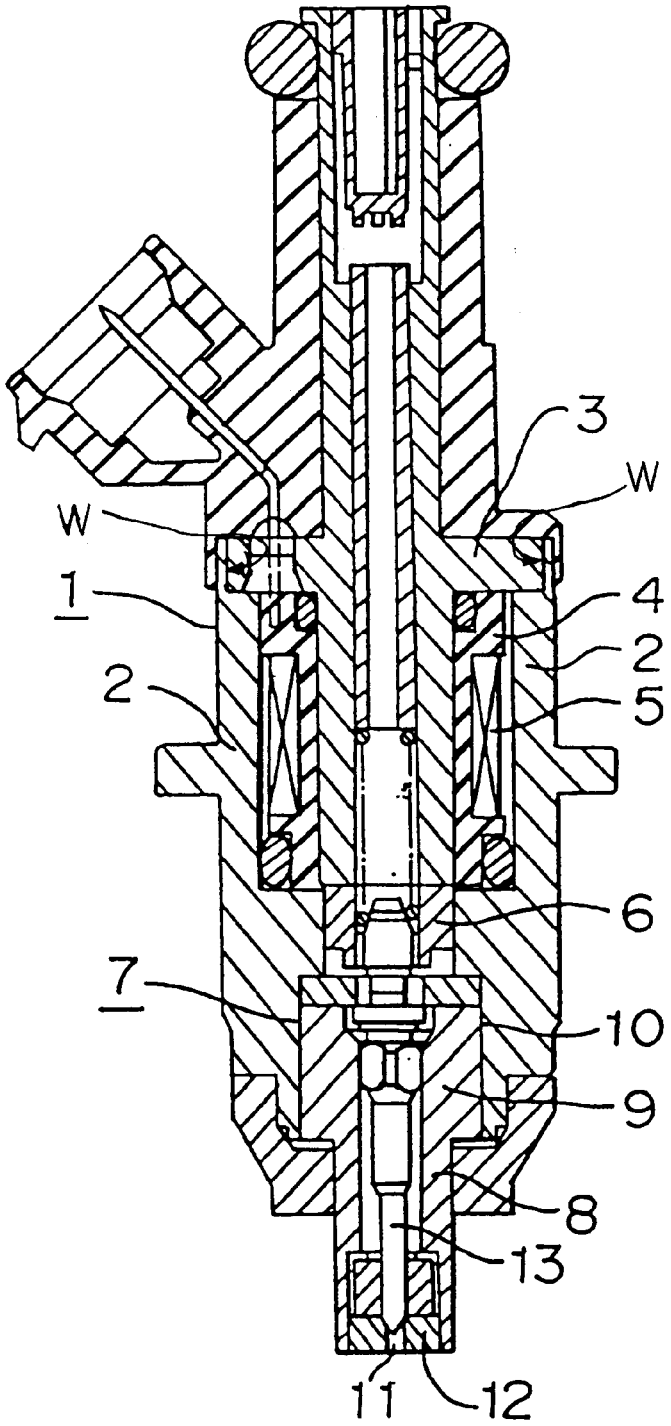
FIG. 1 is a side cross-sectional view showing a cylinder injection type fuel injection valve according to Embodiment 1 and Embodiment 2 of the present invention.

In FIG. 1, a reference numeral 1 designates a cylinder injection type fuel injection valve; a reference numeral 2 designates a housing; and a reference numeral 3 designates a core connected to the housing 2 on the top of the housing 2. A portion connecting the core 3 and the housing 2 is fixed by an encircling welding W. A reference numeral 4 designates a coil assembly; a reference numeral 5 designates a coil; a reference numeral 6 designates an armature; and a reference numeral 7 designates a valve device which is held at an end (the bottom end) of the housing 2 by a connection means such as a caulking. The valve device 7 is provided with a valve body 10 in a cylindrical shape with a stepped portion, which is formed between a cylindrical portion of a small diameter 8 and a cylindrical portion of a large diameter 9, a valve seat 12 having a fuel injection nozzle 11 fixed to a tip portion of a center hole of the valve body 10 within the valve body, and a needle valve 13 which is a valve for opening and closing the fuel injection nozzle 11 by a solenoid device and is located adjacent to the valve seat 12.

Next, an explanation will be given of the operation. When electric current is applied to the coil 5, a magnetic circuit composed of the armature 6, the core 3 and the housing 2 generates a magnetic flux, whereby the armature is attracted to and moved on the side of the core 3. The needle valve 13 integrally constructed with the armature 6 is separated from the valve seat 12, whereby a space appears between the needle valve 13 and the valve seat 12. Then, a highly pressured fuel passes from the valve body 10 to the fuel injection nozzle 11 of the valve seat 12 and atomized from the outlet in the tip of the injection nozzle 11.

As mentioned above, because a portion connecting the core 3 and the housing 2 is welded in its circumference, connecting strength of the connecting portion between the core 3 and the housing 2 is improved, thereby a change in properties by high combustion pressure can be prevented and withstanding pressure can be improved.

EMBODIMENT 2

In the above Embodiment 1, there is shown that the connecting portion between the core 3 and the housing 2 is welded in its entire circumference. However, the connecting portion may be welded by a spot welding at several points. Practically, it is possible to weld a connecting portion between a core 3 and a housing 2 by a laser beam welding at about 10 points. Thus, when a plurality of points are welded by a spot welding, a man-hour can be decreased in comparison with the welding in he entire circumference.

EMBODIMENT 3

Figure 2:
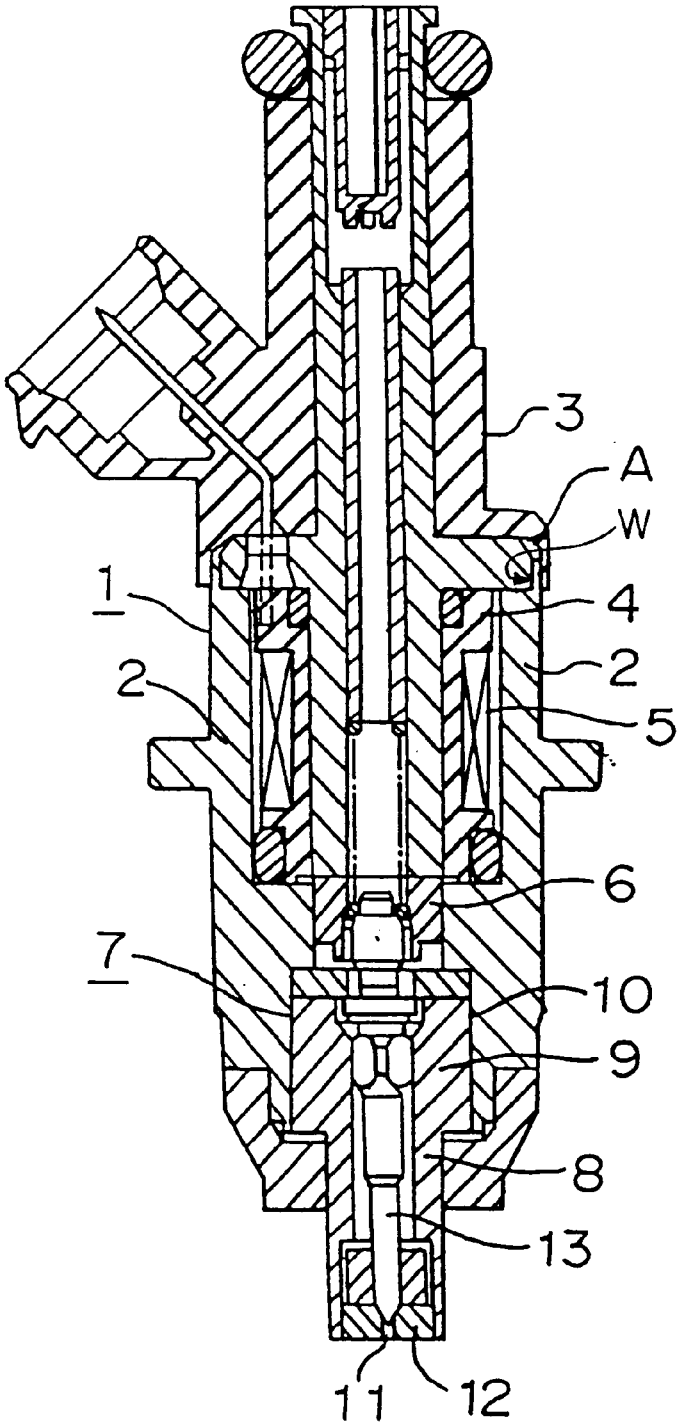
FIG. 2 is a side cross-sectional view showing a cylinder injection type fuel injection valve according to Embodiment 3 and Embodiment 4.
Figure 3:
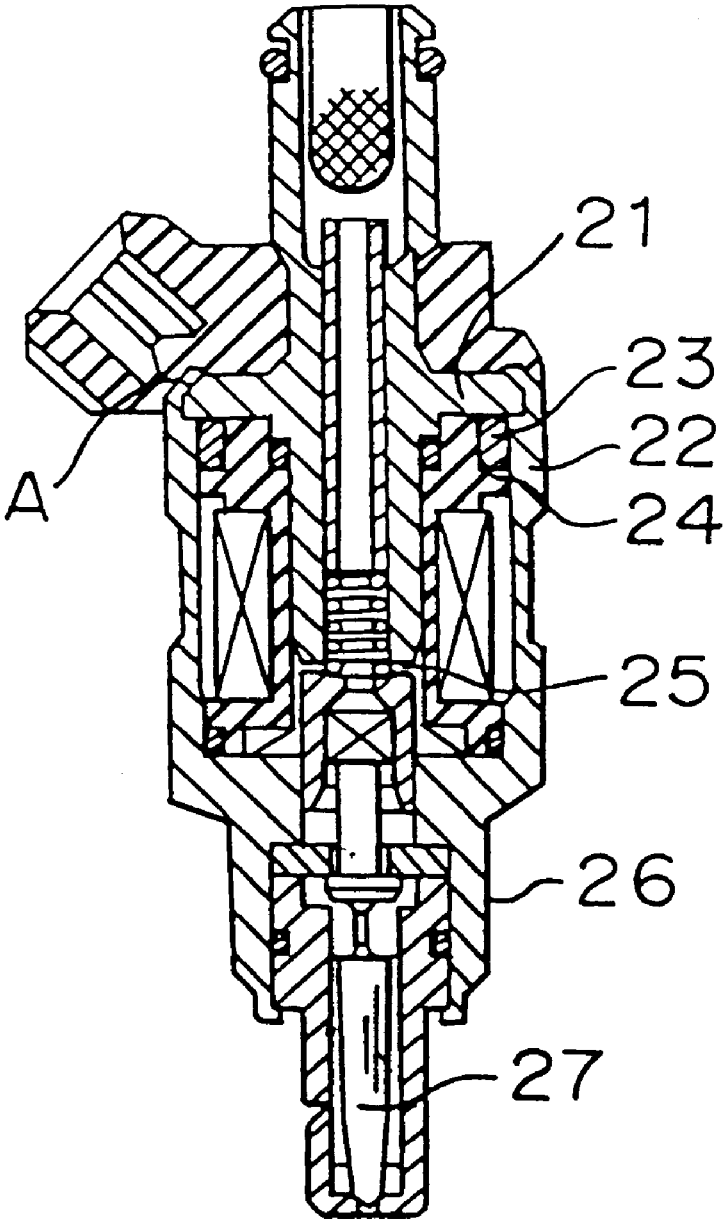
FIGURE 3 PRIOR ART
FIG. 3 is a side cross-sectional view showing a conventional fuel injection valve.

As shown in FIG. 2, it is possible to weld W a connecting portion between the core 3 and the housing 2 after the connecting portion is caulked. In the Figure, a portion A designates a caulked portion. There are another advantages in employing such structure, namely, the connection becomes much stronger than by only a weld; and conventional equipment and/or know-how of a conventional injector can be used for a process of caulking the core 3 and the housing 2.

EMBODIMENT 4

Several points of a connecting portion between a core 3 and a housing 2 are welded by a spot welding after the connecting portion is caulked. Welding of a plurality of points by a spot welding can decrease a man-hour in comparison with a welding of the entire circumference.

EMBODIMENT 5

A core 3 and a housing 2 are engaged by a transition fit, thereafter, a circumferential portion of the engaged portion is welded in the same manner as in the above Embodiments. In other words, the core 3 and the housing 2 are engaged such that gaps and/or interferences may exist between the core and the housing depending on actual measurements of the core and the housing. It is possible to improve weldability without deteriorating capability of assembling by adopting a transition fit.

As stated above, according to a cylinder injection type fuel injection valve of the first aspect of the resent invention, strength of connection between a core and a housing is improved by an encircling welding the connecting portion between the housing and the core, thereby changes in properties caused by high combustion pressure can be prevented and capability of withstanding pressure can be improved.

Further, according to a cylinder injection type fuel injection valve of the second aspect of the present invention, it is possible to decrease a man-hour in comparison with a welding in the entire circumference of a connecting portion between a housing and a core because the connecting portion is welded by a spot welding at a plurality of points.

Further, according to a cylinder injection type fuel injection valve of the third aspect of the present invention, it is possible to increase strength of a connection between a housing and a core in comparison with a connection using only welding and to use equipment and/or know-how of a conventional injector for a process of caulking the core and the housing because a part of the connecting portion between the housing and the core is welded in its entire circumference after caulking.

Further, according to a cylinder injection type fuel injection valve of the fourth aspect of the present invention, a connection between a housing and a core can be strong and a man-hour can be decreased in comparison with a welding in the entire circumference because the connecting portion between the housing and the core is welded by a spot welding at a plurality of points after caulking.

Further, according to a cylinder injection type fuel injection valve of the fifth aspect of the present invention, it is possible to improve weldability without deteriorating capability of assembling because a core and a housing are engaged by a transition fit.

Obviously, numerous modifications and variations of the present invention are possible in light of the above teachings. It is therefore to be understood that within the scope of the appended claims, the invention may be practiced otherwise than as specifically described herein.

What is claimed is:

1. A cylinder injection type fuel injection valve comprising:

a valve body of a cylindrical type;

a valve seat having an injection nozzle for injecting fuel at the center thereof;

a valve capable of abutting on and separating from the valve seat to open and close the injection nozzle;

a hollow housing connected to the valve body at one end;

a solenoid located in the inside of the housing for operating the valve to be opened and closed; and a core which is connected to the housing at one end to form a magnetic circuit in association with the housing, wherein a connecting portion between the housing and the core is encirclingly welded.

2. A cylinder injection type fuel injection valve according to claim 1, wherein the housing and the core are engaged by a transition fit.

3. A cylinder injection type fuel injection valve comprising:

a valve body of a cylindrical type;

a valve seat having an injection nozzle for injecting fuel at the center thereof;

a valve capable of abutting on and separating from the valve seat to open and close the injection nozzle;

a hollow housing connected to the valve body at one end;

a solenoid located in the inside of the housing for operating the valve to be opened and closed; and a core which is connected to the housing at one end to form a magnetic circuit in association with the housing, wherein a connecting portion between the housing and the core is encirclingly welded and wherein the connecting portion between the housing and the core is caulked before the welding.

4. A cylinder injection type fuel injection valve according to claim 3, wherein the housing and the core are engaged by a transition fit.

5. A cylinder injection type fuel injection valve comprising:

a valve body of a cylindrical type;

a valve seat having an injection nozzle for injecting fuel at the center thereof;

a valve capable of abutting on and separating from the valve seat to open and close the injection nozzle;

a hollow housing which is connected to the valve body at one end;

a solenoid located in the inside of the housing for operating the valve to be opened and closed; and a core which is connected to the housing at one end to form a magnetic circuit in association with the housing;

wherein a connecting portion between the housing and the core is welded by a spot welding at a plurality of points; and wherein the housing and the core are engaged by a transition fit.

6. A cylinder injection type fuel injection valve comprising:

a valve body of a cylindrical type;

a valve seat having an injection nozzle for injecting fuel at the center thereof;

a valve capable of abutting on and separating from the valve seat to open and close the injection nozzle;

a hollow housing which is connected to the valve body at one end;

a solenoid located in the inside of the housing for operating the valve to be opened and closed; and a core which is connected to the housing at one end is to form a magnetic circuit in association with the housing, wherein a connecting portion between the housing and the core is welded by a spot welding at a plurality of points, and wherein the connecting portion between the housing and the core is caulked before the welding.

7. A cylinder injection type fuel injection valve according to claim 6, wherein the housing and the core are engaged by a transition fit.

* * * * *